US005116474A

United States Patent [19]

Fuentes et al.

[11] Patent Number: 5,116,474

[45] Date of Patent: May 26, 1992

[54] PROCESS FOR IMPROVING THE DRAINAGE CAPACITY OF A PAPER PULP USING AN ENZYME OBTAINED FROM THE FUNGUS *HUMICOLA INSOLENS* OR THE BACTERIUM CELLULOMONAS

[75] Inventors: M. Jean-Luc Fuentes, Villenave D'ornon; M. Christian Rousset, Biganos; M. Gerard Goma, Ramonville; M. Jean-Claude Pommier, Gradignan, all of France

[73] Assignee: LA Cellulose Du Pin, Bordeaux, France

[21] Appl. No.: 591,268

[22] Filed: Oct. 1, 1990

[30] Foreign Application Priority Data

Oct. 2, 1989 [FR] France ..... 89 12823

[51] Int. Cl.[5] ..... D21H 25/02

[52] U.S. Cl. ..... 162/71; 162/72; 435/277; 435/278

[58] Field of Search ..... 162/72, 70, 71; 435/277, 278

[56] References Cited

U.S. PATENT DOCUMENTS 4,923,565 5/1990 Fuentes et al. ..... 162/72

FOREIGN PATENT DOCUMENTS 2604190 3/1980 France ..... 162/72

*Primary Examiner*—Steve Alvo

*Attorney, Agent, or Firm*—Oblon, Spivak, McClelland, Maier & Neustadt

[57] ABSTRACT

A process for treating paper pulp using an enzyme composition. An enzyme composition containing cellulases or hemicellulases selected from among those derived from the fungus *Humicola insolens* and from the bacterium Cellulomonas is made to act upon an aqueous suspesnion of the pulp possessing a given Schopper-Riegler level (SR) according to Standard NFQ 50 003. This procedure is particularly useful for treating a recycled fiber-based paper pulp having a pH of at least 5.

18 Claims, 1 Drawing Sheet

○ : Lipase A40 ● : Celluzyme 1500T △ : Celluzyme 0,7T

PROCESS FOR IMPROVING THE DRAINAGE CAPACITY OF A PAPER PULP USING AN ENZYME OBTAINED FROM THE FUNGUS *HUMICOLA INSOLENS* OR THE BACTERIUM CELLULOMONAS

BACKGROUND OF THE INVENTION

1. Field of the Invention

The present invention is related to the paper-making industry, and in particular the recycled paper sector. More specifically, a new procedure is described for treating paper pulp using an enzyme composition which allows, most notably, good machining properties of the pulp during the manufacture of paper.

2. Discussion of the Background

The paper-making industry makes increasing use of recycled paper. With regard to the manufacture of corrugated cardboard, for example, increasing use is being made of recycled fiber-based raw materials, and at the same time, the number of recycling processes is increasing. During each of these recycling operations, however, the quality of the raw material deteriorates. To restore a satisfactory level of mechanical properties, the pulp is generally treated in an aqueous suspension, thereby causing machinability problems, especially those related to the water drainage properties of the paper-making composition.

Pulps in aqueous suspensions ready to be used on a paper-making machine may be characterized by various parameters. An especially important property is the SR value, with respect to the expectation that the pulp will possess water-drainage properties. The Schopper-Riegler level (SR) of a pulp is defined as a factor for evaluating the quality of the pulp for the manufacture of paper. It is an expression of the capacity of water to become separated from the suspension under conditions specified in Standard NFQ 50 003. On a scale of 0 to 100, a high SR value signifies a low drainage rate of the suspension, while a low value signifies a faster drainage rate. It has been observed, for example, that the SR of a pulp which has been subjected to a treatment operation increases to a greater or lesser extent, depending on the degree of treatment undergone, in comparison with a pulp which has not been subjected to an operation of this kind.

This parameter plays an especially important role in the manufacturing capacity of the paper-making machine. Indeed, to increase this capacity, the water-drainage phase must take the shortest possible time. When using suspensions possessing a high SR level, the concentration of pulp must be increased in order to maintain a given rate of manufacture. This phenomenon leads to inferior sheet formation, since the fibers are distributed with greater difficulty. A special advantage is gained, therefore, by using suspensions having a relatively low SR value.

As soon as the suspensions possess an SR level greater than 25, it becomes desirable to attempt to lower it to improve the conditions under which the paper is made. This decrease is made desirable by two considerations. First, the productivity of the paper-making machine can be improved because of accelerated drainage, and second, the manufacturing rate can be preserved without being forced to compensate for the slowness of drainage by reducing the dilution of the suspension, a step which could lead to poor sheet formation.

European Patent No. 0 262 040 describes a procedure for the treatment of paper pulps in aqueous suspensions, especially recycled fiber-based pulps having an SR level of at least 25 which, through the use of enzyme compositions containing cellulases and/or hemicellulases, allows a reduction of the SR and thus an improved drainage of the suspension and improved manufacturing capacity of the paper-making machine.

Enzyme preparations containing cellulases and/or hemicellulases as described are preferably those which possess a $C_1$ activity, a $C_x$ activity, and a xylanase activity. These three activities are defined by the international enzyme nomenclature and may be designated and expressed as units of the international system per milligram of powder of the enzyme composition in question. The $C_1$ activity is the activity of the cellobiohydrolase, which may be measured on pure, highly structured cellulose. This activity is demonstrated by the production of cellobiose, and the International System has chosen AVICEL® as the reference substrate. The $C_x$ activity is measured on modified cellulose, i.e., carboxymethylcellulose (CMC), and is quantified by a decrease in the viscosity of the carboxymethylcellulose or an increase in reducing sugars. The xylanase activity makes possible the hydrolysis of the linking xylans.

As described in the patent cited above, the reactive medium may be more or less suited to the action of the enzymes. Temperature and pH conditions are set to avoiding any risk of denaturation of the enzymes by the medium. The pH thus ranges advantageously between 3 and 7, and the temperature between 20° and 60° C. Above 60° C. the medium tends to denature the enzyme, and below 20° C. the action of the enzymes is produced especially slowly. Using the enzyme compositions described, it is recommended that the pH range between approximately 3 and 7.

Some paper-making recycled fiber-based compositions may possess a high pH which exceeds 7. In this case, it may be necessary to reduce the pH in order to achieve optimal conditions for action of the enzyme compositions.

The reduction of the pH is normally achieved by adding acid, such as sulfuric acid. In addition to the disadvantage of this additional operation, adding an acid may cause disturbances in sheet formation on the paper-making machine, e.g., the reduced effectiveness of certain agents such as retention agents.

Furthermore, in the case of printing and writing papers, for example, a large quantity of acid must be added, thereby decreasing the economic advantage of the enzyme treatment procedure.

SUMMARY OF THE INVENTION

Accordingly, one object of the present invention is to provide cellulase and/or hemicellulase enzyme compositions which do not require modifications of the sheet-formation procedure and in which pH's greater than those used in prior art processes may be employed.

These and other objects which will become apparent from the following specification have been achieved by the process of the present invention, in which the SR of paper-making compositions is lowered, especially those containing recycled fibers possessing an SR greater than 25, by using enzyme compositions containing at least one alkaline cellulase selected from among those produced by fermenting the fungus *Humicola insolens* and those produced by the bacterium *Cellulomonas*.

BRIEF DESCRIPTION OF THE DRAWINGS

A more complete appreciate of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1C:
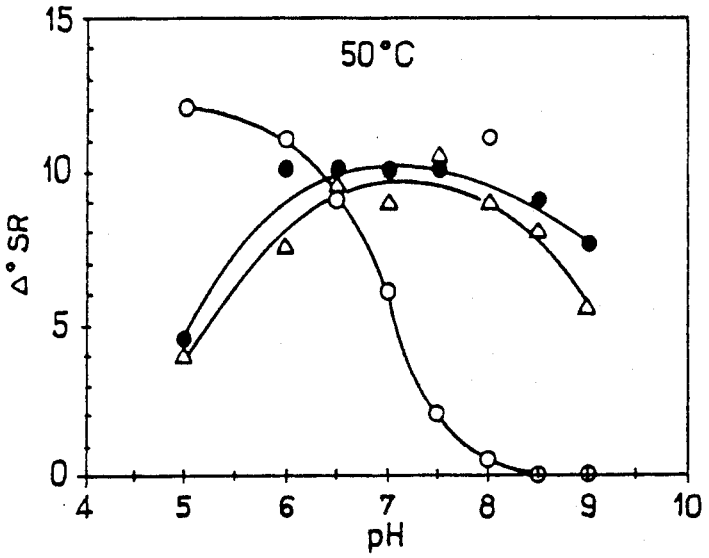
FIGS. 1*a*, 1*b* and 1*c* show the activity of enzymes of the present invention, CELLUZYME 1500T and CELLUZYME 0.7T, (both cellulase enzymes) relative to a conventional cellulase (LIFTASE A40) in terms of SR values over a given pH range at temperatures of 30° C., 40° C. and 50° C., respectively.
Figure 1B:
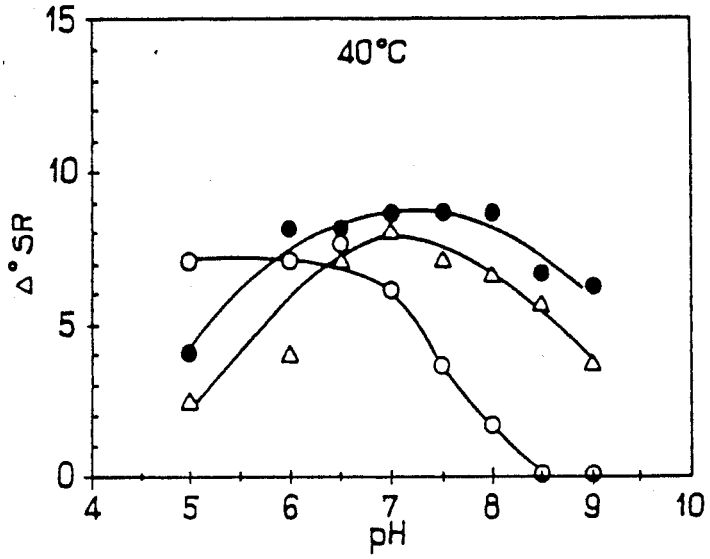
Figure 1A:
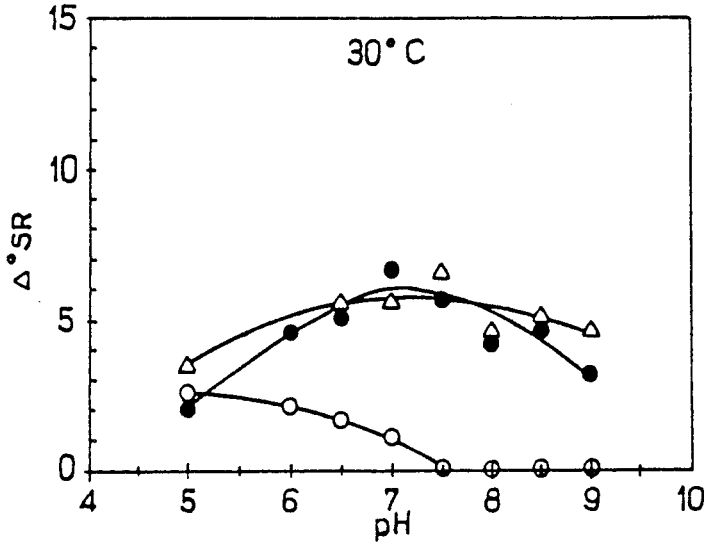

The alkaline cellulases and cellulase-containing compositions preferably used are obtained from strains which have been deposited at an international microorganism depositing authority and which bear the reference numbers CBS 39269, CBS 14764, ATCC 16454, ATCC 26908, and ATCC 34627 for the *Humicola insolens* fungus, and UDA 8200, FIMI 11341, and UDA 11494 for the Cellulomonas bacterium.

All of the cellulases have a CMC activity ($C_x$) and a filter paper activity which is higher at a pH of 7 or 9 than at a pH of 5. The paper filter activity corresponds to the measurement of the reducing sugars released by the action of the enzyme composition on the paper filter (WHATMAN® paper filter).

According to one aspect of the invention, a paper-making pulp, especially a recycled fiber-based pulp, is treated using an enzyme composition possessing a maximum activity, expressed in relation to the decrease of the SR level, at pH values greater than 6.

The enzyme or enzyme compositions according to the invention may be used in concentrations of between about 0.01% and 2% by weight of the paper pulp in the dry state.

In accordance with the invention, one may also use enzyme compositions produced under the trade name CELLUZYME® by the NOVO Company. These compositions contain cellulases produced by fermenting the *Humicola insolens* fungus.

The enzyme treatment of the pulp is generally conducted at temperatures between about 20°-60° C. The time of treatment is variable and depends upon the treatment temperature and the ultimate SR value desired of the pulp. Obviously, longer reaction times are required at temperatures and pH values outside the maximum activity range of the enzymes. Treatment times sufficient to produce a satisfactory SR value can be readily determined by one skilled in the art. Generally, treatment times range from about 5 minutes to about 60 minutes, preferably from about 10 minutes to about 40 minutes.

Treatment with the enzymes according to the process of the present invention is generally conducted at a pH of from 5-9.

After a treatment using the enzyme compositions according to the invention, the paper-making compositions in aqueous suspension are introduced onto a conventional paper-making machine comprising: (1) a manufacturing table equipped with a tank providing a stream of pulp in aqueous suspension used for sheet formation, the manufacturing table being covered with cloth for drainage of the pulp; (2) a press section; and (3) a drying section.

Other features of the invention will become apparent in the course of the following descriptions of exemplary embodiments which are given for illustration of the invention and are not intended to be limiting thereof.

EXAMPLES

In all of the examples described, the SR properties indicated were determined in accordance with Standard NFQ 50 003 (measured on a pulp in homogeneous suspension of 2 g/1).

EXAMPLES 1 to 15

An aqueous suspension of a paper, recycled fiber-based pulp was prepared as follows:

1 kg dry weight of a pulp composed solely of fibers obtained from recycled cardboard boxes was weighed out and used to make an aqueous suspension containing 3% by weight through the addition of water up to a total weight of 33.333 kg. The pH was adjusted so as to obtain a pH of 5, 6, 7, 8, and 9, depending on the example, and then the fibrous suspension was heated to the desired temperature (50° C., 40° C., or 30° C. depending on the example). Once this temperature was reached, 3 g of a cellulase-based powder bearing the tradename CELLUZYME® 1500T, made by the NOVO Company, was added. The enzymes were allowed to react while being stirred for thirty minutes. The aqueous suspension was diluted by adding enough water to obtain a suspension of 7 g/1, and the SR level was measured. The values obtained are indicated in the Table below. In this way, 15 examples differing by temperature and pH were produced.

EXAMPLES 16 to 30

The preceding procedure was used, except that a new enzyme composition, i.e., a cellulase-based powder produced under the tradename CELLUZYME® 0.7 T by the NOVO Company was used.

EXAMPLES 31 to 33

The procedure used for Examples 6, 8, and 10, respectively, was repeated, using an enzyme composition containing cellulases obtained from the strain CBS 14764 of the *Humicola insolens* fungus.

The enzymatic composition was obtained in the following manner. The strain as supplied by the international deposit authority, the Centraalbureau Voor Schimmelrcultures (CBS), was transferred to a sterile medium containing cellulose and having a pH of 6. After culturing for seven days at 40° C., the mycelium was filtered out from the fermentation medium. The filtrate thus obtained was lyophilized to obtain a powder that was used in a proportion of from 0.01 to 2% by weight of the dry weight of the paper pulp to be treated.

EXAMPLES 34 to 36

The procedure used for examples 6, 8, and 10 was repeated using an enzyme composition containing cellulases obtained from strain UDA 11494 of the Cellulomonas bacterium.

The enzyme composition was obtained in the following manner. The strain as supplied by the international deposit authority was transferred to a sterile medium containing cellulose and having a pH of 7. After culturing for seven days at 25° C., the cells were filtered out from the fermentation medium. The filtrate thus obtained was lyophilized to obtain a powder that was used in a proportion of from 0.01 to 2% by weight of the dry weight of the paper pulp to be treated.

COMPARATIVE EXAMPLES 37 to 51

The procedure used in the preceding examples was repeated, except that the enzyme compositions according to the invention were replaced by an enzyme composition marketed under the name MAXAZYME® CL 2000 by the Rapidase Company. This compound was derived from the microorganism *Trichoderma viride* and is described in the European patent already mentioned, EP 0 262 040.

A control example appearing at the bottom of the Table did not use any enzyme composition.

To better demonstrate the reactivity of the enzyme compositions according to the invention, the variations of the SR level as a function of pH for the three temperatures used in examples 1–30 and 37–51 are shown in the attached Figures. The Δ SR is the difference of the SR levels of the paper pulps as measured before and after the enzyme treatment.

The graphs show the high reactivity of the enzymes used according to the invention for pH's greater than 6, while the reactivity of enzyme compositions used in the prior art decreases very markedly for pH values greater than 6. The unexpected effectiveness of the enzyme compositions according to the invention may also be noted when the treatment is carried out at 30° C.

On the paper-making machine, the action of the enzymes is translated into improved drainage and increased speed of the machine. This makes possible greater dilution of the paper-making composition in the headbox and improved paper making.

Obviously, numerous modifications and variations of the present invention are possible in light of the above teachings. It is therefore to be understood that within the scope of the appended claims, the invention may be practiced otherwise than as specifically described herein.

TABLE

| Ex. | T °C. | pH | SR* | ΔSR |
|---|---|---|---|---|
| 1 | 50 | 5 | 39.5 | 4.5 |
| 2 | " | 6 | 34 | 10 |
| 3 | " | 7 | 34 | 10 |
| 4 | " | 8 | 33 | 11 |
| 5 | " | 9 | 36.5 | 7.5 |
| 6 | 40 | 5 | 40 | 4 |
| 7 | " | 6 | 36 | 8 |
| 8 | " | 7 | 35.5 | 8.5 |
| 9 | " | 8 | 35.5 | 8.5 |
| 10 | " | 9 | 38 | 6 |
| 11 | 30 | 5 | 42 | 2 |
| 12 | " | 6 | 39.5 | 4.5 |
| 13 | " | 7 | 37.5 | 6.5 |
| 14 | " | 8 | 40 | 4 |
| 15 | " | 9 | 41 | 3 |
| 16 | 50 | 5 | 40 | 4 |
| 17 | " | 6 | 36.5 | 7.5 |
| 18 | " | 7 | 35 | 9 |
| 19 | " | 8 | 35 | 9 |
| 20 | " | 9 | 38.5 | 5.5 |
| 21 | 40 | 5 | 41.5 | 2.5 |
| 22 | " | 6 | 40 | 4 |
| 23 | " | 7 | 36 | 8 |
| 24 | " | 8 | 37.5 | 6.5 |
| 25 | " | 9 | 40.5 | 3.5 |
| 26 | 30 | 5 | 40.5 | 3.5 |
| 27 | " | 6 | 39.5 | 4.5 |
| 28 | " | 7 | 38.5 | 5.5 |
| 29 | " | 8 | 39.5 | 4.5 |
| 30 | " | 9 | 39.5 | 4.5 |
| 31 | 40 | 5 | 42 | 2 |
| 32 | " | 7 | 39 | 5 |
| 33 | " | 9 | 39 | 4 |
| 34 | " | 5 | 40 | 4 |
| 35 | " | 7 | 34 | 10 |
| 36 | " | 9 | 34 | 8 |
| COMPARATIVE EXAMPLES | | | | |
| 37 | 50 | 5 | 32 | 12 |
| 38 | " | 6 | 33 | 11 |
| 39 | " | 7 | 38 | 6 |
| 40 | " | 8 | 43.5 | 0.5 |
| 41 | " | 9 | 44 | 0 |
| 42 | 40 | 5 | 37 | 7 |
| 43 | " | 6 | 37 | 7 |
| 44 | " | 7 | 38 | 6 |
| 45 | " | 8 | 42.5 | 1.5 |
| 46 | " | 9 | 44 | 0 |
| 47 | 30 | 5 | 41.5 | 2.5 |
| 48 | " | 6 | 42 | 2 |
| 49 | " | 7 | 43 | 1 |
| 50 | " | 8 | 44 | 0 |
| 51 | " | 9 | 44 | 0 |
| CONTROL | | | 44 | 0 |

*SR before enzyme treatment
ΔSR is the difference of the SR levels measured before and after the enzyme treatment

What is Claimed as New and Desired to be Secured by Letters Patent of the United States is:

1. A process for treating paper pulp, comprising:

contacting an aqueous suspension of said pulp having a Schopper-Riegler (SR) value of at least 25 determined according to Standard NFQ 50 003 with a cellulase or hemicellulase enzyme or enzyme composition containing a cellulase or hemicellulase enzyme at a pH in the range 7–9, wherein said enzyme or enzyme composition comprises an enzyme obtained from the fungus *Humicola insolens* or from the bacterium Cellulomonas, and said contacting improves the drainage capacity of said paper pulp.

2. The process of claim 1, wherein said enzyme is obtained from the strains CBS 39269, CBS 14764, ATCC 16454, ATCC 26908, or ATCC 34627 for the *Humicola insolens* fungus, and UDA 8200, FIMI 11341, or UDA 11494 for the Cellulomonas bacterium.

3. The process of claim 2, wherein said enzyme is obtained from the strains CBS 14764 or UDA 11494.

4. The process of claim 1, wherein said contacting is conduct a temperature between 20° and 60° C.

5. The process of claim 4, wherein said temperature is approximately 30° C.

6. The process of claim 1, wherein said paper pulp is recycled fiber-based paper pulps.

7. The process of claim 1, wherein said enzyme or enzyme containing composition produces the highest activity relative to the decrease in the SR of the paper pulp at pH values greater than 6.

8. The process of claim 1, wherein said enzyme or enzyme-containing composition has a carboxymethylcellulose activity ($C_x$) and a filter paper activity ($C_1$) which is higher at a pH 7 or 9 than at a pH of 5.

9. The process of claim 1, wherein said enzyme or enzyme-composition is present at a concentration of between about 0 01–2 wt. % based on said paper pulp in the dry state.

10. A process for improving the drainage capacity of a paper pulp composition, comprising:

contacting said paper pulp composition with a cellulase or hemicellulase enzyme or enzyme composition containing a cellulase or hemicellulase at a pH in the range 7–9, wherein said enzyme or enzyme composition comprises an enzyme obtained from the fungus *Humicola insolens* or from the bacterium Cellulomonas, and said contacting improves the drainage capacity of said paper pulp composition.

11. The process of claim 10, wherein said enzyme is obtained from the strains CBS 39269, CBS 14764, ATCC 16454, ATCC 26908, or ATCC 34627 for the *Humicola insolens* fungus, and UDA 8200, FIMI 11341, or UDA 11494 for the Cellulomonas bacterium.

12. The process of claim 11, wherein said enzyme is obtained from the strains CBS 14764 or UDA 11494.

13. The process of claim 10, wherein said contacting is conducted at a temperature between 20° and 60° C.

14. The process of claim 13, wherein said temperature is approximately 30° C.

15. The process of claim 10, wherein said paper pulp is recycled fiber-based paper pulps.

16. The process of claim 10, wherein said enzyme or enzyme-containing composition produces the highest activity relative to the decrease in the SR of the paper pulp at pH values greater than 6.

17. The process of claim 10, wherein said enzyme or enzyme-containing composition has a carboxymethylcellulose activity ($C_x$) and a filter paper activity ($C_1$) which is higher at a pH 7 or 9 than at a pH of 5.

18. The process of claim 10, wherein said enzyme or enzyme-composition is present at a concentration of between about 0.01–2 wt. % based on said paper pulp in the dry state.

* * * * *